US005364236A

United States Patent [19]

Herron et al.

[11] Patent Number: 5,364,236

[45] Date of Patent: Nov. 15, 1994

[54] PULSE DAMPER

[76] Inventors: Ross W. Herron, 24110 Bingham Pointe Dr., Bingham Farms, Mich. 48025; Garry E. Beard, 34024 Burton La., Livonia, Mich. 48154

[21] Appl. No.: 101,256

[22] Filed: Aug. 3, 1993

[51] Int. Cl.[5] ..... F04B 11/00

[52] U.S. Cl. ..... 417/312; 417/540

[58] Field of Search ..... 417/540, 312, 533

[56] References Cited

U.S. PATENT DOCUMENTS 3,109,584 11/1963 Gerteis ..... 417/312

4,715,790 12/1987 Iijima et al. ..... 417/312 X 4,764,097 8/1988 Hirahara et al. ..... 417/540 X

*Primary Examiner*—Richard E. Gluck

[57] ABSTRACT

Improved pulse dampers are received within compressor housings. This is an improvement over prior art systems which topically attached a pulse damper outwardly of the compressor housing. The improved pulse dampers have various configurations to reduce the magnitude and timing between pulses. This in turn reduces the noise caused by the pulses.

12 Claims, 2 Drawing Sheets

PULSE DAMPER

BACKGROUND OF INVENTION

This invention in general relates to improvements in pulse dampers, and in particular to improvements in pulse dampers for use with dual compressors.

Dual reciprocating piston compressor systems are often utilized in modern compressor systems. In particular, they are utilized in air conditioning systems. However, when reciprocating piston compressors are utilized, there are pulses due to the alternating compression cycles. These pulses result in knocking noises, which are undesirable.

To address the knocking problem, dual compressor systems typically include a pulse damper, whose purpose is to eliminate these pulses, thereby reducing noise. When air conditioning compressors utilized on vehicles incorporate such pulse dampers, undesirable large amounts of space are often required. In one known prior art system, a pulse damper is positioned outwardly of the compressor housing. This adds undesirable space and expense to the system.

It would be desirable to develop a pulse damper which is incorporated into the housing of the compressor, thereby eliminating any extra space being required for the pulse dampening feature. It has been somewhat difficult, however, to fully reduce the pulses in the limited space available in typical compressor housings.

SUMMARY OF THE INVENTION

The disclosed embodiments of the present invention include pulse dampers which are incorporated into the housing of a compressor. In this way they reduce the required space for the compressor system.

In one disclosed embodiment, the compressor housing includes opposed fluid paths from dual compressors which meet a central outlet. A damper body is placed over the outlet, and has a bore which expands conically outwardly to reduce pulses.

In further features of the present invention, a spreader body is positioned in each of the opposed fluid paths leading from the compressor to the outlet. The spreader body divides the flow into a number of discrete paths, which are directed into each other, eliminating or reducing the pulses.

In further features of the present invention, a cap is positioned at an outlet end of the damper body to reduce the pulses. Several embodiments of the cap are disclosed in this application. In one preferred embodiment, the cap includes a maze-like path dividing and recombining the flow repeatedly. The maze-like path may divide the flow into two paths of varying lengths. In this way, the flow if repeatedly divided and recombined over varying time periods to eliminate the time between pulses and the magnitude of the pulses, and, thereby eventually eliminating the pulses themselves.

Further features of the present invention may be best understood from the following specifications and drawings, of which the following is a brief description.

DETAILED DESCRIPTION OF A PREFERRED EMBODIMENT

Figure 1:
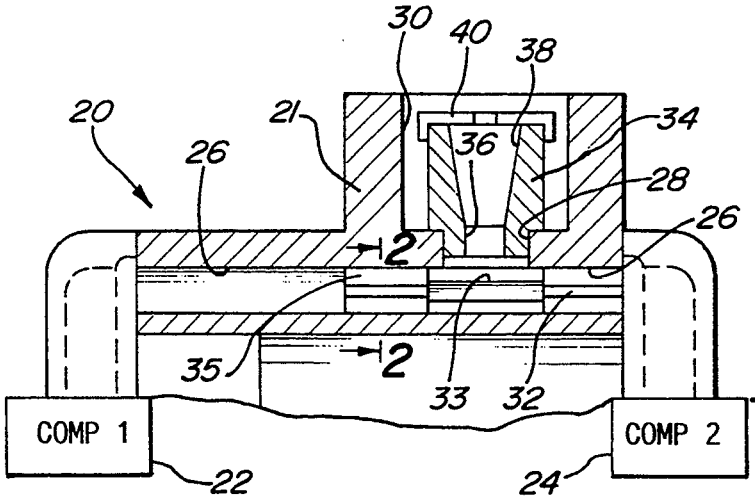
FIG. 1 is a cross-sectional view through a compressor system.

FIG. 1 shows a compressor system 20 incorporating a housing 12 with a first compressor 22 and a second compressor 24 each leading to outlet paths 26. Typically several additional compressors are included. In one known compressor system, the actual compressors are reciprocating dual phase compressors each delivering pulses which are 180° out of phase. The actual outlets leading to paths 26 are typically spaced downwardly from paths 26 as shown in this Figure. In order to eliminate the timing between these 180° spaced pulses, the several compressors are operated out of phase from each other. Thus several pulses lead to a single outlet 28 from outlet paths 26, with the pulses each being spaced. A plenum 30 is found in housing 21 on standard dual compressor systems downstream of outlet 28.

The present invention positions a spreader 32 in the combined paths 26. Spreader 32 includes a central open portion 33 which allows flow over 360° up into the outlet 28. Fins 35 are formed circumferentially spaced about the central axis of spreader 32 and divide the flows from both lines 26 into several discrete components. A damper body 34 is positioned in outlet 28 and defines a bore inlet 36 which expands conically outwardly to an outlet 38 having a larger cross section than inlet 36. In one example, the outlet 38 has a cross-sectional area four times that of the inlet 36.

By expanding the cross-sectional area, one reduces pulses. A cap ,40 is shown somewhat schematically at a downstream end of pulse damper body 34. The cap 40 bends the flow to further reduce pulses.

Figure 2:
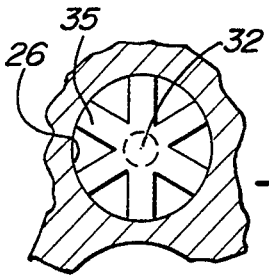
FIG. 2 is a cross-sectional view along line 2—2 as shown in FIG. 1.

FIG. 2 is a cross-sectional view along line 2—2 as shown in FIG. 1. As shown, spreader 32 has fins 35 spaced around its circumference. Although shown as separate parts, it would be possible to cast spreader 32 integrally in the housing.

Figure 3:
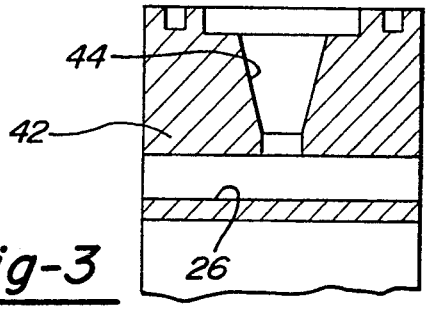
FIG. 3 shows an alternative embodiment.

As shown in FIG. 3, an alternate damper body 42 may be formed integrally with the portion of the compressor housing which forms paths 26. Bore 44 is formed integrally within damper body 42.

Figure 4:
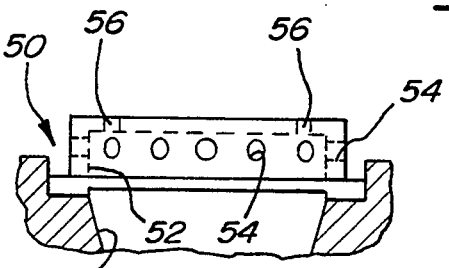
FIG. 4 shows an alternative embodiment for one portion of the system shown in FIG. 1.

FIG. 4 shows an embodiment of a cap, such as cap 40, shown schematically in FIG. 1. As shown, cap 50 includes a central bore 52 leading from outlet 38. Bore 52 leads to a plurality of ports 54 leading to an outer peripheral surface of cap 50. Further, axial end ports 56 are formed in cap 50. In other embodiments of the present invention, only the outer peripheral ports 54 need be utilized, or only the end ports 56 need be utilized.

Figure 5:
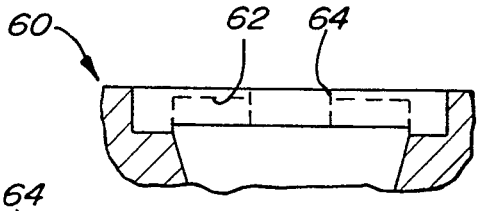
FIG. 5A shows an alternative embodiment of the features show in FIG. 4.
FIG. 5B is an end view of the embodiment shown in FIG. 5A.
Figure 5B:
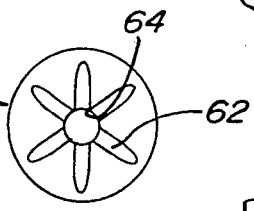

As shown in FIG. 5A, an alternative cap 60 includes a plurality of grooves 62, which lead to a central port 64. FIG. 5B shows the several spaced grooves 62.

Figure 6:
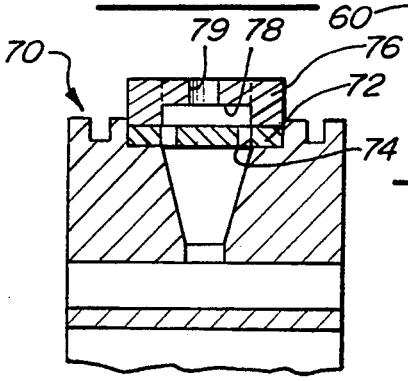
FIG. 6 shows yet another embodiment.

FIG. 6 shows a two-part cap embodiment incorporating a first part 72 having bores 74 leading to grooves 78 in a second part 76. Grooves 78 lead to bore 79.

Figure 7:
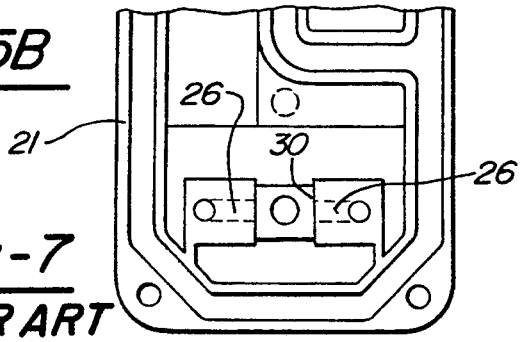
Fig-7 PRIOR ART
FIG. 7 shows a standard compressor housing.

FIG. 7 shows compressor housing 21 having passages 26 leading to the outlet plenum 30. Plenum 30 receives pulse damper body 34. (See FIG. 1 ). Thus, the entire pulse damper body is received within compressor housing 70. The cap and pulse damper body are secured to housing 21 in some way. They may be fixed by conventional method or held by a cover over plenum 30.

Figure 8:
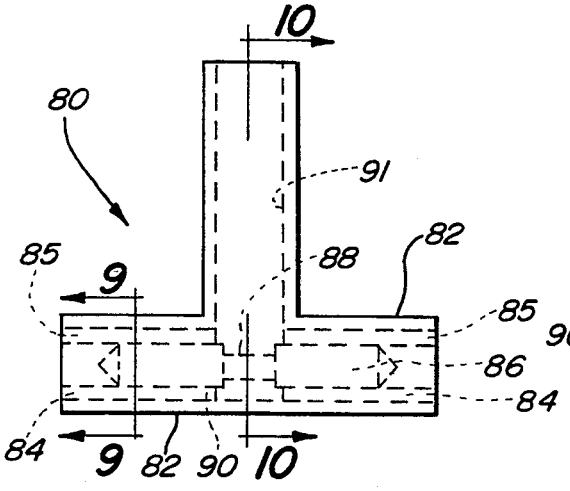
FIG. 8 shows an alternative damper system.

An alternative pulse damper 80 is illustrated in FIG. 8. Pulse damper body 80 has a pair of spaced ends 82 to be received within passages 26. Each end 82 has an internal bore 84 which receives flow from passage 26. Each bore 84 includes fins 85 extending inwardly from an inner peripheral surface of the bore. A spreader body 86 is received within the bore 84, at inner peripheral ends of fins 85. Clearances 90 are formed between fins 85 to allow fluid flow. Central portion 88 of spreader 86 has a smaller circumference allowing flow to pass around 360°. An outlet passage 91 leads outwardly.

Figure 9:
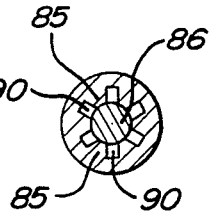
FIG. 9 is a cross-sectional view along line 9—9 as shown in FIG. 8.

As shown in FIG. 9, fins 85 extend radially inwardly from an inner peripheral surface of bore 84. Spaces 90 alternate with fins 85.

Figure 10:
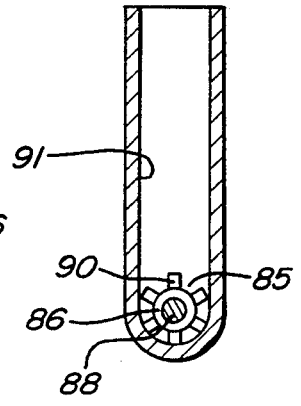
FIG. 10 is a cross-sectional view along line 10—10 shown in FIG. 8.

As shown in FIG. 10, spreader 86 has central portion 88 wherein a smaller circumference is formed to allow flow from clearances 90 to pass around 360°, and lead into outlet 91.

Figure 11:
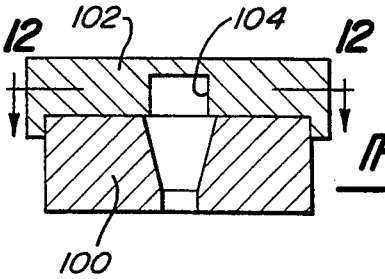
FIG. 11 is a view of another embodiment of the present invention.

FIG. 11 shows a further type of pulse damper according to the present invention. As shown, a damper body 100, similar to body 34 as shown in FIG. 1, may have a maze-like cap 102 which receives flow through an opening 104 from pulse damper body 100.

Figure 12:
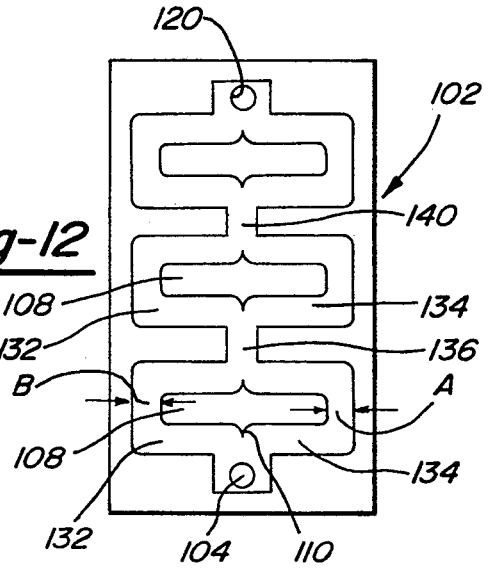
FIG. 12 is a cross-sectional view along line 12—12 as shown in FIG. 11.

As shown in FIG. 11 and 12, the flow leaving the damper body 100 entering maze-like cap 102 is bent through a 90° bend.

A first embodiment maze-like cap 102, having a maze path 130 is shown in FIG. 12. As shown, passage 104 leads towards a separator land 108 having a forwardmost portion 110 which splits the flow into two paths 132 and 134. The fluid flows around separator 108 and is recombined at passage 136. The fluid then encounters a second separator 108 and is divided into another pair of passages 132 and 134. The flow is recombined at passage 140. The splitting and recombining may be repeated until the flow reaches an outlet 120. It should be understood that a cover plate would be positioned over the cap 102 to enclose maze path 130.

When flow moves through outlet 104 from the upstream damper body, it is divided into passages 132 and 134, twists around separator 108, and is recombined in passage 136. Flow is then re-separated, and recombined in passage 140. The combined flows strike each other in opposite directions, thereby reducing the magnitude of the pulses and thus the noise.

In one embodiment of the present invention, it is envisioned that by making the time required for the flow entering passages 132 and 134 to reach passage 136 different, the timing between pulses can be reduced, and the noise of the flow can be reduced. To this end, the cross-sectional flow area of passage 132 and 134 can be made different. That is, the distance A on passage 134 and the distance B of passage 132 can be made different. If distance B is smaller than distance A, then flow from passage 132 would reach passage 136 at a different time then the flow through passage 134. In this way, the timing between different pulses will be reduced. That is, the pulses entering outlet 104 are separated into passages 132 and 134. By spacing the time it takes for those pulses to reach passage 136, one is increasing the number of pulses reaching passage 136, but reducing the magnitude. In this way, the flow at passage 136 becomes more like a steady small pulse rather than a plurality of spaced larger pulses. The effect will be even more pronounced at passage 140.

Figure 13:
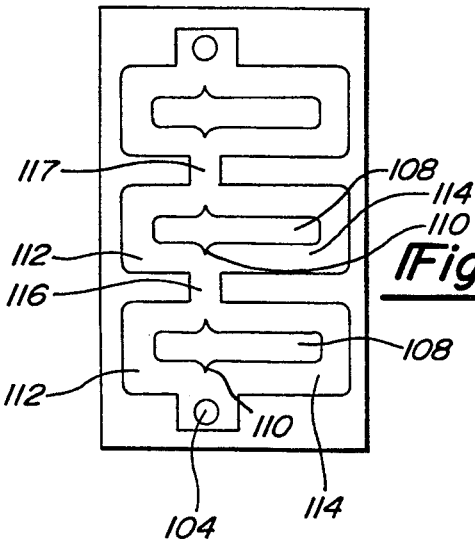
FIG. 13 is a view of a further embodiment of the present invention similar to that shown in FIG. 12.

As shown in FIG. 13, a similar effect can be achieved by having passages 112 and 114 be of different lengths. As shown, passage 114 is approximately 1.5 times as long as passage 112. In this way, the pulses entering passage 12 get to passage 116 quicker than those from passage 114. Similarly, the pulses reaching passage 117 through the second passage 112 arrive there quicker than those from passage 114. It should be understood that a pulse leaving passage 12 and entering the first combination flow passage 116 would again be split in two by portion 110 on the second separator 108. Although only three such separators are shown, it should be understood that more could be utilized.

Figure 14:
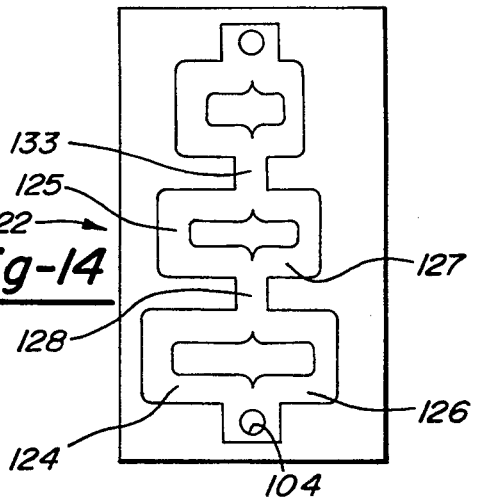
FIG. 14 is a view of yet another embodiment of the present invention similar to that shown in FIG. 12.

A further embodiment is illustrated in FIG. 14. As shown, a body 122 has passages 124 and 126 leading to a combination passage 128. The flow from passage 128 is again split into passages 125 and 127 which are recombined in passage 133. The opposed passages are of different lengths so that the above-discussed effect occur, while at the same time the length at the downstream passages is reduced to reduce the time between pulses. As an example, the passage 124 may be 1.5 times as long as the passage 126, and the passage 125 may be half as long as passage 124 with passage 127 being half as long as passage 126. In this way, the timing between pulses becomes decreased at each combination passage.

As discussed above, by reducing the magnitude of each pulse, and by reducing the distance between the pulses, one reduces the resulting noise.

Preferred embodiments of the present invention have been disclosed, however, a worker of ordinary skill in the art would recognize that certain modifications would come within the scope of this invention. For that reason, the following claims should be studied in order to determine the true scope and content of this invention.

We claim:

1. A dual compressor system comprising:

a compressor housing body having a passage centered on a first axis and extending between first and second ends, said housing body, receiving a first compressor having an outlet leading to said first end, said compressor housing body also receiving a second compressor having an outlet leading to said second end, and fluid from said first and second compressors extending in opposed directions in said passage such that pulses in flow from first and second compressors are directed into each other; and a pulse damper bore positioned in said passage and intermediate said first and second ends, and directing flow along a second axis extending at a 90° angle relative to said first axis, said pulse damper bore having an inlet cross section of a first cross-sectional area centered on said second axis and an outlet cross section downstream of said inlet cross section of a second cross-sectional area, also centered on said second axis, said second cross-sectional area being greater than said first cross-sectional area such that a cross-sectional area of said pulse damper bore expands from said inlet cross-section to said outlet cross-section.

2. A compressor system as recited in claim 1, wherein a spreader is positioned within said first and second paths, said spreader dividing the flow in said first and second paths into a plurality of discrete flows.

3. A pulse damper as recited in claim 1, wherein said pulse damper bore is formed by a body which is a separate member from said compressor housing.

4. A pulse damper as recited in claim 1, wherein said pulse damper bore is formed by a body which is integral to said compressor housing.

5. A pulse damper as recited in claim 1, wherein a cap is fitted on said outlet end of said pulse damper bore.

6. A dual compressor system comprising:

a compressor housing body receiving a first compressor having an outlet leading to a first path extending along a first axis, said compressor housing body also receiving a second compressor having an outlet leading to a second path extending along a second axis, said first and second axes being co-axial and said first and second paths extending in opposed directions; and a pulse damper bore positioned between said first and second paths, and directing flow along a third axis extending at a 90° angle relative to said first and second axes, said pulse damper bore having an inlet cross section of a first cross-sectional area and an outlet cross section downstream of said inlet cross section of a second cross-sectional area, said second cross-sectional area being greater than said first cross-sectional area of said pulse damper bore; and a spreader positioned within said first and second paths, said spreader dividing the flow in said first and second paths into a plurality of discrete flows.

7. A pulse damper as recited in claim 6, wherein said spreader includes a plurality defined in fins integral to an internal bore of said compressor housing body to divide the flow about said spreader,

8. A pulse damper as recited in claim 6, wherein fins extend radially outward from said spreader and are closely spaced from an internal bore defined in said compressor housing body to define said discrete flow paths.

9. A pulse damper as recited in claim 6, wherein said spreader has flow dividing members which extend to ends spaced from a central location aligned with said inlet cross-section of said pulse damper bore such that flow from each of the discrete flows created by said spreader may flow through 360° relative to said first and second axes and enter said inlet cross section of said pulse damper bore.

10. A pulse damper as recited in claim 6, wherein said pulse damper bore expands conically from said inlet cross-section to said outlet cross-section.

11. A dual compressor system comprising:

a compressor housing body receiving a first compressor having an outlet leading to a first path extending along a first axis, said compressor housing body also receiving a second compressor having an outlet leading to a second path extending along a second axis, said first and second axes being co-axial and said first and second paths extending in opposed directions;

a pulse damper bore positioned between said first and second paths, and directing flow along a third axis extending at a 90° angle relative to said first and second axes, said pulse damper bore having an inlet cross section of a first cross-sectional area and an outlet cross section downstream of said inlet cross section of a second cross-sectional area, said second cross-sectional area being greater than said first cross-sectional area of said pulse damper bore; and a cap being fitted on said outlet and of said pulse damper bore.

12. A pulse damper as recited in claim 11, wherein said cap includes a maze-like flow path.

* * * * *

UNITED STATES PATENT AND TRADEMARK OFFICE

CERTIFICATE OF CORRECTION

PATENT NO. : 5,364,236

DATED : November 15, 1994

INVENTOR(S) : Ross W. Herron; Garry E. Beard

It is certified that error appears in the above-indentified patent and that said Letters Patent is hereby corrected as shown below:

Claim 7, column 6, line 2, after "plurality" delete "defined in" and insert --of--

Claim 7, column 6, line 3, after "bore" delete "of" and insert --defined in--

Claim 10, column 6, line 19, after "bore" delete "expands" and insert --extends--

Signed and Sealed this

Twenty-first Day of February, 1995

*Attest:*

Bruce Lehman

BRUCE LEHMAN

*Attesting Officer*

*Commissioner of Patents and Trademarks*